United States Patent [19]

Nakamura

[11] Patent Number: 4,956,669

[45] Date of Patent: Sep. 11, 1990

[54] CONTROL APPARATUS FOR CONTROLLING DENSITY OF TONER IN A DEVELOPING UNIT

[75] Inventor: Minoru Nakamura, Osaka, Japan

[73] Assignee: Minolta Camera Kabushiki Kaisha, Osaka, Japan

[21] Appl. No.: 336,064

[22] Filed: Apr. 11, 1989

[30] Foreign Application Priority Data

Apr. 13, 1988 [JP] Japan ..... 63-90744

[51] Int. Cl.[5] ..... G03G 21/00

[52] U.S. Cl. ..... 355/208; 355/207; 355/246

[58] Field of Search ..... 355/207, 208, 246, 215, 355/245, 253; 118/691, 689

[56] References Cited

U.S. PATENT DOCUMENTS

| | | | |
|---|---|---|---|
| 4,210,864 | 7/1980 | Miyakawa et al. | 355/246 X |
| 4,260,073 | 4/1981 | Baumann | 118/691 X |
| 4,348,099 | 9/1982 | Fantozzi | 355/208 |
| 4,423,948 | 1/1984 | Kimura et al. | 355/246 |
| 4,431,298 | 2/1984 | Arai et al. | 355/246 |
| 4,447,145 | 5/1984 | Snelling et al. | 355/246 X |
| 4,572,654 | 2/1986 | Murai et al. | 355/246 X |
| 4,579,442 | 4/1986 | Minejima | 355/253 |
| 4,592,645 | 6/1986 | Kanai et al. | 355/206 |
| 4,646,679 | 3/1987 | Ohno et al. | 118/691 |
| 4,708,458 | 11/1987 | Ueda et al. | 355/206 |

FOREIGN PATENT DOCUMENTS 56-148017 11/1981 Japan .

*Primary Examiner*—A. T. Grimley
*Assistant Examiner*—Sandra L. Hoffman
*Attorney, Agent, or Firm*—Burns, Doane, Swecker & Mathis

[57] ABSTRACT

A control apparatus for controlling concentration of toner incorporated in developing material in a developing unit by means of controlling a toner replenishment to supply the toner in accordance with a toner concentration detected by a toner concentration detecting sensor in a first state wherein the detecting signal of the sensor is normal and to supply the toner by a constant volume at the predetermined period in a second state wherein the detecting signal of the sensor is abnormal.

11 Claims, 13 Drawing Sheets

| | e | d | c | b | a |
|---|---|---|---|---|---|
| | Di5 | Di4 | Di3 | Di2 | Di1 |

⇩

| | e | d | c | b | a |
|---|---|---|---|---|---|
| | Di6 | Di5 | Di4 | Di3 | Di2 |

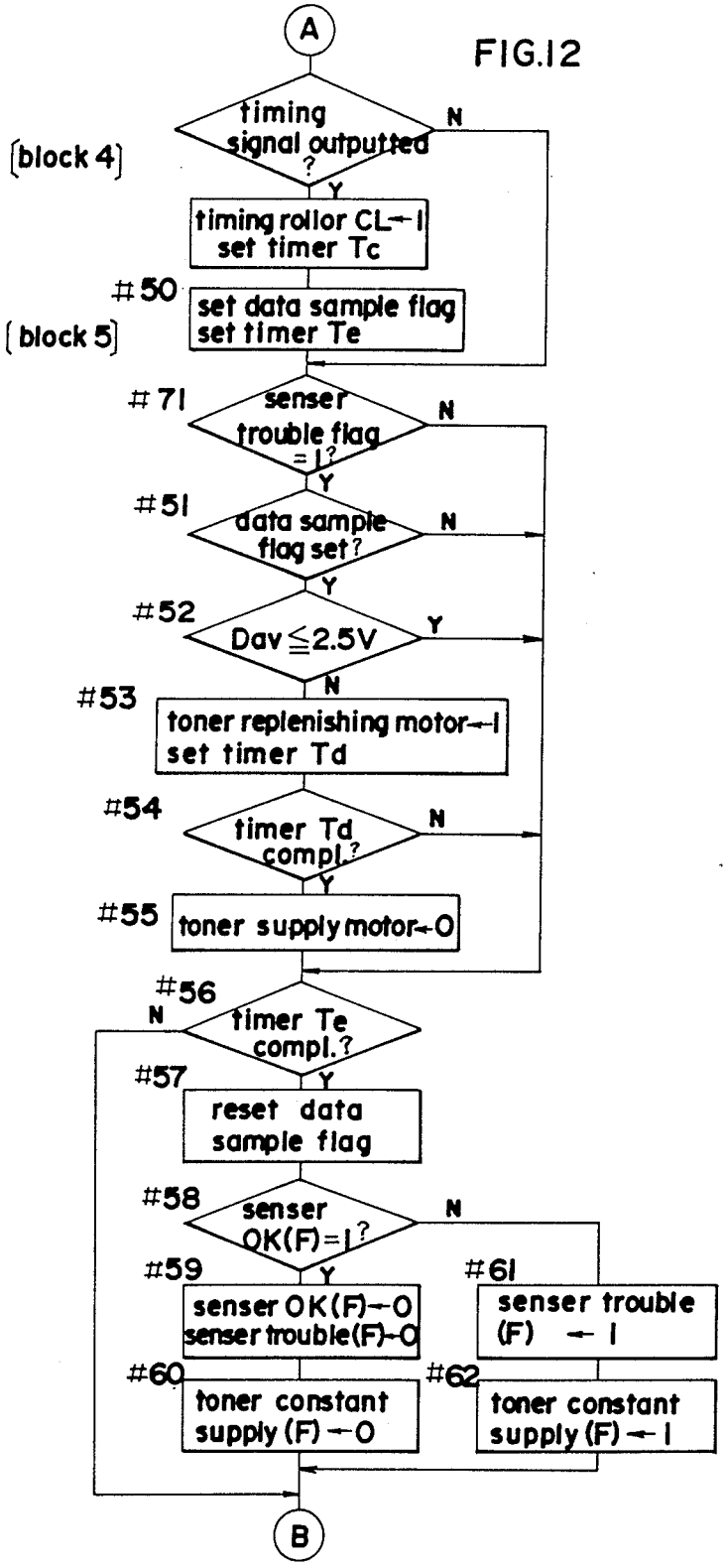
A
FIG.12
[block 4]
timing signal outputted ?
N
Y
timing rollor CL←1
set timer Tc
#50
set data sample flag
set timer Te
[block 5]
#71
senser trouble flag =1?
N
Y
#51
data sample flag set?
N
Y
#52
Dav≦2.5V
Y
N
#53
toner replenishing motor←1
set timer Td
#54
timer Td compl.?
N
Y
#55
toner supply motor←0
#56
timer Te compl.?
N
Y
#57
reset data sample flag
#58
senser OK(F)=1?
N
Y
#59
senser OK(F)←0
senser trouble(F)←0
#61
senser trouble (F) ← 1
#60
toner constant supply (F) ←0
#62
toner constant supply (F) ← 1
B

CONTROL APPARATUS FOR CONTROLLING DENSITY OF TONER IN A DEVELOPING UNIT

BACKGROUND OF THE INVENTION

1. Field of the Invention

The present invention relates to a control apparatus for controlling the density of toner in a developing unit used in copy machines, laser printers or like image forming apparatus that forms images by toner development.

2. Description of the Prior Art

Conventionally, toner concentration detecting sensors for detecting developer toner concentration have been provided in the toner transport section within the developing unit and toner accommodating section to enable development with uniform image density. Toner is supplied to the developing unit in accordance with the toner concentration detected by said toner concentration detecting sensors. Thus, the developing material toner concentration can be stably maintained within the developing unit.

However, accurate detection of toner concentration cannot be achieved due to toner accumulation and adhesion to the top of the sensor. For these reasons an elastic cleaning blade or brush is attached to the support shaft used for transport/mixing of the developing material so as to clean the surface of the sensor by making rubbing contact with the surface of said sensor in conjunction with the rotation of the support shaft.

However, the cleaning member becomes bent and folded because it makes repeated rubbing contact with the toner concentration detecting sensor, making proper operation impossible. Further, toner concentration detecting sensor output may not be input to the microcomputer or other control device due to disconnection or a breakdown of said sensor itself. Consequently, if for some reason the cleaning member does not operate, the output from the toner concentration detecting sensor increases, toner concentration is judged to be low, and toner replenishment is excessive. The developed toner image therefore attains an extremely high concentration and the toner overflows the developing unit and soils the surrounding region.

Further, a breakdown which impedes sensor output being input to the microcomputer controller leads to a determination that toner concentration is high, and results in extremely low toner image density after development because toner replenishment has been discontinued.

SUMMARY OF THE INVENTION

Accordingly, a main object of the present invention is to provide an improved control apparatus for controlling toner density which can eliminate the aforesaid disadvantages.

A further object of the present invention is to provide a control apparatus for controlling toner concentration without either excessive or insufficient toner replenishment, even when normal toner sensor output is lacking.

These and other objects are attained by a toner density control apparatus comprising a toner concentration detecting sensor, provided in the developing unit, for detecting toner concentration, an abnormality discriminating means for discriminating abnormal state where said detecting sensor is incapable of detecting real toner concentration, and for outputting an abnormal signal indicating the abnormal state, a toner replenishing means for replenishing toner to the developing unit, and a control means for controlling said toner replenishing means to replenish the toner in accordance with the toner concentration detected by said toner concentration detecting sensor in a first state wherein said abnormality discriminating means does not output the abnormal signal, and to replenish the toner by a constant volume at the predetermined period in a second state wherein said abnormality discriminating means outputs the abnormal signal. The aforesaid construction may also be provided a cleaning member for cleaning the detecting portion of the concentration detecting sensor.

BRIEF DESCRIPTION OF THE DRAWINGS

These and other objects or features of the present invention will become apparent from the following description of a preferred embodiment thereof taken in conjunction with the accompanying drawings, in which:

FIGS. 11 through 14 are flow charts showing the copy operation control subroutines.

In the following description, like parts are designated by like reference numbers throughout the several drawings.

DESCRIPTION OF THE PREFERRED EMBODIMENT

Figure 1:
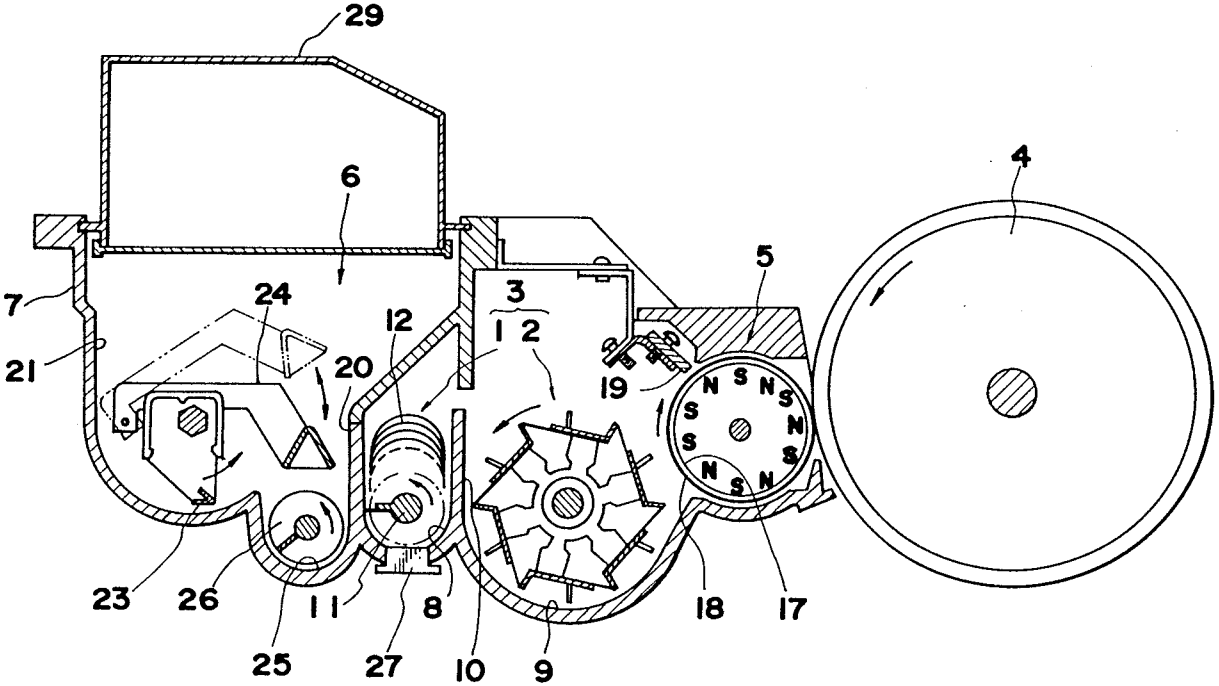
FIG. 1 is a cross section view of a developing unit incorporating the toner density control apparatus of the present invention.

The present invention is described hereinafter by way of concrete examples with reference to the accompanying drawings.

The developing unit provides first and second transport sections which mix a dual-component developing material comprising a mixture of a toner and a carrier, said first and second transport sections having interposed therebetween a developing material transport section 3 which repeatedly circulates and transports said developing material, developing section 5 which transports the developing material from the second transport section 2 of developing material transport section 3 to a photoreceptor drum 4, and a toner accommodating section 6 which supplies toner to the first transport section 1 of developing material transport section 3.

First and second transport sections 1 and 2 are disposed adjacent to the bottom of casing 7, have first and second transport paths 8 and 9 which are provided curved bottoms, and are separated by a partition 10. Partition plate 10 is provided communicating paths 10*a* and 10*b*, shown in FIG. 2, disposed at two points in the foreground and interior of FIG. 1.

In the first transport section 1, support shaft 11 is disposed along first transport path 8 at an inclination that is lower on the side of communicating path 10*a* and higher on the side of communicating path 10*b*. Support shaft 11 is provided a large number of mixing blades 12 which stir and mix the developing material with the rotation of support shaft 11 and transport said developing material from the fore side to the interior along first transport path 8 so as to feed developer into the second transport path 9 through communicating path 10*b*.

In the second transport section 2, support shaft 14 is arranged along second transport path 9. Support shaft 14 is provided mixing blades 15, which transport the developing material from the interior to the forefront as they mix and return said developing material to first transport path 8 through communicating path 10*a*, and buckets 16 which move the developing material transported from the second transport path 9 to the developing section.

Developing section 5 is provided a developing sleeve 18, magnetic roller 17 disposed within said developing sleeve 18, and a brush-height regulating member 19 which controls the height of the magnetic brush of the developing material.

After completion of the developing process, developing material remaining on developing sleeve 18 is mixed with the developing material in second transport path 9 and recirculated.

On the other hand, toner accommodating section 6 which supplies the toner comprises a casing 7 which forms a hopper 21 that is separated from the aforesaid first transport section 1 by partition wall 20. The toner in the toner accommodating section 6 is replenished from a toner cartridge 29 detachably mounted thereabove. In toner hopper 21, the bottom of casing 7 is curved to provide a toner replenishing passage 25 between first transport section 1 and the neighboring section. Replenishing toner passes through communicating path 20*a* provided at the foreside of partition wall 20 via an inclined surface 30. Inclined surface 30 has an angle equal to or greater than an angle of repose of the toner so as to facilitate the flow of the toner toward first transport path 8.

The interior of toner hopper 21 is provided a mixing member 23 for stirring and mixing the toner on the replenishing passage 25 side, and an empty detecting device 24. Replenishing passage 25 is provided a transport blade 26 which transports toner from the interior of replenishing passage 25 to the front through communicating path 20*a* so as to supply toner to the first transport section 1. Toner is replenished by developing material transport section 3 in accordance with the toner concentration of the developing material.

Figure 2:
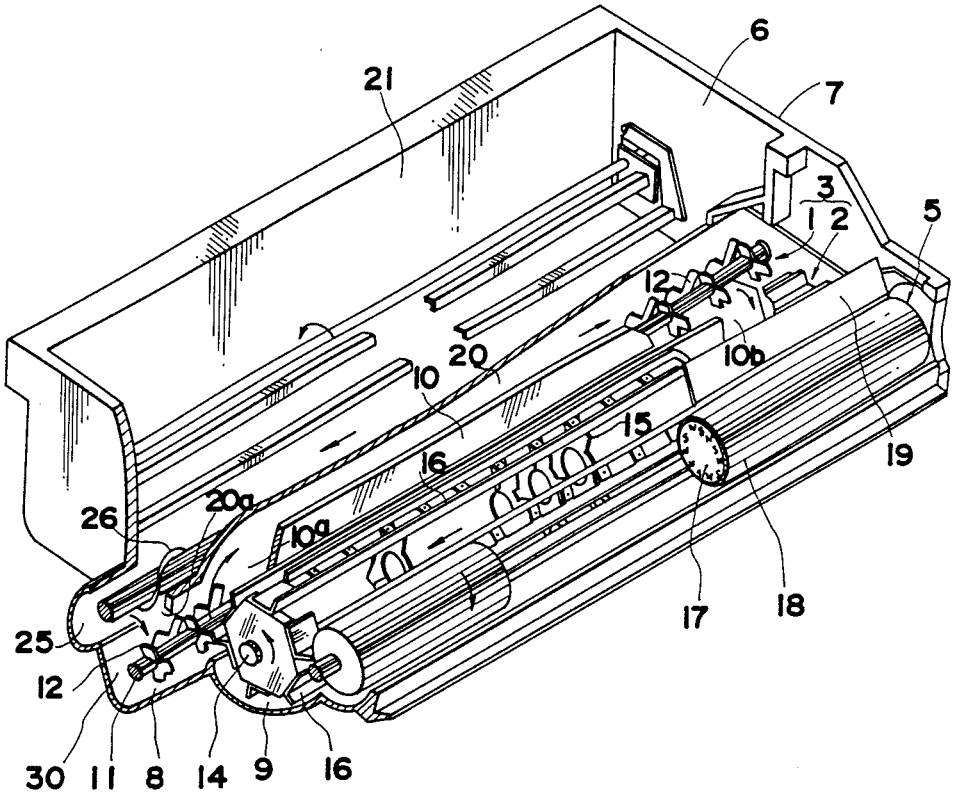
FIG. 2 is a partial perspective view of a portion of the developing unit.
Figure 3:
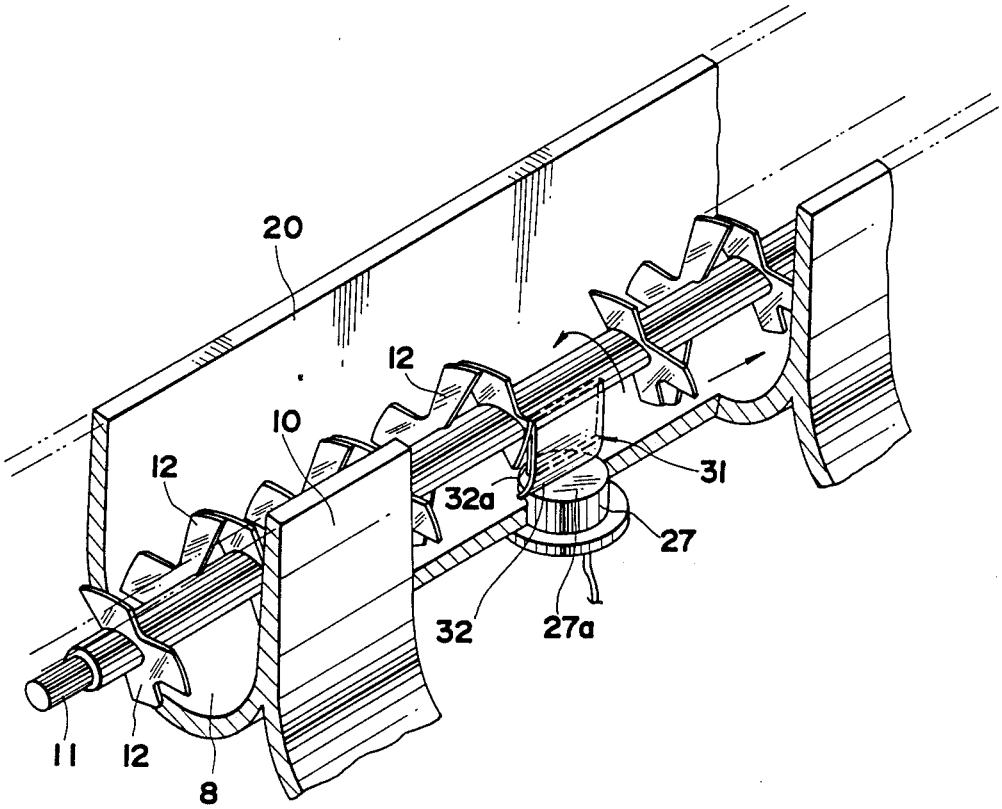
FIG. 3 is a perspective view of the toner concentration sensor mounting.

A toner concentration detecting sensor 27 is therefore provided in first transport path 8 to detect toner concentration of the developing material, as shown in FIGS. 1 and 3. Sensor surface 27*a* of sensor 27 is flat and smooth and conforms to the surface of transport path 8.

Sensor 27 detects variations in toner concentration as a variation in magnetic permeability of the toner incorporated in said developing material. The detection value is output to CPU 201, shown in FIG. 7, which acts as the control unit for operations control of the copy machine.

Figure 4:
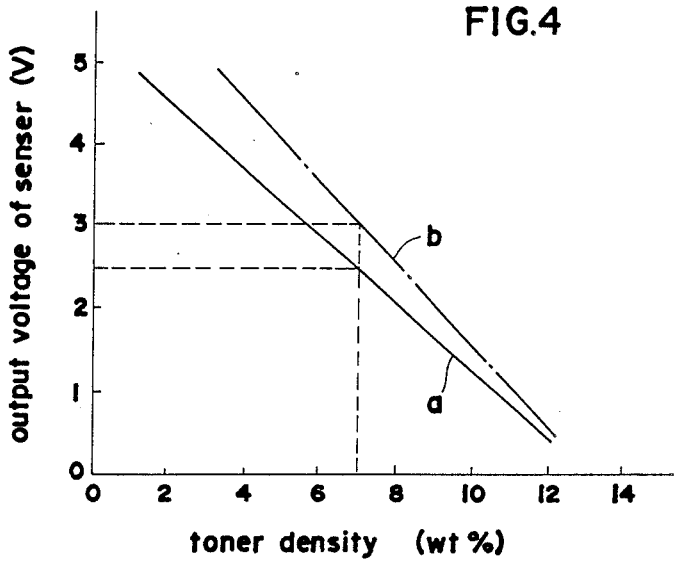
FIG. 4 shows toner concentration sensor output characteristics.

The sensor characteristics of toner concentration detecting sensor 27, i.e. toner concentration (Wt %) vs. sensor output voltage (V) characteristics, are set in the relation described in FIG. 4, and in the present embodiment, the reference concentration as a judging standard is set at 7.0 Wt %, with the corresponding sensor output voltage being set at 2.5 V.

Moreover, support shaft 11 is provided a developing material exchanging means 31 at the region confronting toner concentration detecting sensor 27. Developing material exchanging means 31 includes a scrape-up member 32*a* integrally attached to support shaft 11 in the axial direction, and a cleaning member 32 of, for example, polyester film of 0.05 mm thickness fixedly attached to said scrape-up member 32*a*.

As support shaft 11 rotates, cleaning member 32 rubs against the upper surface 27*a* of sensor 27 at a constant period (300 ms) to prevent adhesion of the toner to the surface 27*a*, and the developing material above said toner concentration detecting sensor 27 is stirred so as to be exchanged with developing material from adjacent regions. Therefore, toner does not adhere to the upper surface of toner concentration detecting sensor 27, the developing material is not retained at the sensor location, and toner concentration can be detected as it is transported to the developing section 5.

Each time the upper surface 27*a* of toner concentration detecting sensor 27 is periodically rubbed clean by cleaning member 32, the viscosity of the developing material increases due to the sweeping action of said cleaning member 32 which depresses the toner onto the sensor surface 27*a*. The quantity of carrier present above sensor surface 27*a* is therefore increased and the output of sensor 27 is elevated. The sensor output waveform periodically expresses a peaked ripple N, as described by line c in FIG. 5.

Between the aforesaid ripples N, however, the output waveform forms a comparatively flat stable region F because the toner accumulates in its natural state.

Toner concentration in the developing material is determined by sampling sensor output from the stable region F to avoid the influence of ripple N induced by the cleaning of sensor surface 27*a*.

Further, cleaning member 32 may be comprised of, for example, a small, bent and rigid polyester film of 0.05 mm thickness. However, the leading edge of said cleaning member 32 may be lost as it becomes permanently bent by the repeated sweeps over the sensor surface 27*a*, in which case the cleaning operation is impaired. The sensor 27 may also be impaired by disconnection of the sensor leads or poor connection of same.

When the cleaning operation performed by cleaning member 32 is impaired, the carrier in developing material is retained on top of the sensor surface 27*a*, sensor output is rapidly elevated, and the toner concentration detecting sensor output voltage characteristics undergo a change from the normal state described by line a in FIG. 4 to an abnormal state described by line b in the same drawing. Accordingly, the output of sensor 27 is changed as described by line d in FIG. 5. Toner replenishment continues based on the toner concentration detection data of sensor 27 even after cleaning member 32 is damaged as described above, so that said toner replenishment is excessive because the detected toner concentration is lower than the actual concentration.

The aforesaid situation results in the developed image on photoreceptor drum 4 having density that is greater than the set density.

The sensor output voltage does not change when toner concentration cannot be detected due to impairment of sensor 27, or when sensor 27 output, for whatever reason, is not input to CPU 201. Thus, when toner is replenished in accordance with the output of sensor 27 after the above described impairment of said sensor, toner concentration is detected as being very much greater than it actually is. If toner replenishment is discontinued, however, image density decreases, albeit gradually.

Since the aforesaid situation is difficult to quickly ascertain, in practice large quantities of unsuitable copies or prints may be made before its discovery. In addition, excessive toner replenishment may cause soiling of the surrounding area due to toner overflow. However, these problems occur because toner replenishment is based on the detection of toner concentration, and when switching to conventional constant-volume toner replenishment which lacks the previously described sensor control, suitable images are obtained with only slight variance in image density.

The present invention detects the above described situation as abnormal toner concentration output, and switches to a constant-volume toner replenishment mode to as to enable constant image formation. In the present embodiment, warns of abnormalities in toner concentration detection and initiates countermeasures.

Abnormalities in toner concentration detection can be detected and judged in CPU 201 as output abnormalities from sensor 27. The aforesaid output abnormalities are regulated as described in the table below.

| Detection abnormality source | Sensor output abnormality |
|---|---|
| (1) Abnormal cleaning for some reason | (i) Sensor output lacks ripple N |
| (2) Sensor impairment, disconnection, or poor connection | (ii) Sensor output lacks ripple N |
| | (iii) Sensor output unchanged over a fixed time |

Toner concentration detection abnormalities arise from source (2) only when cleaning of sensor surface 27*a* is not accomplished; it is unnecessary to discriminate abnormalities due to source (1).

Accordingly, the sensor is judged to operate properly when even a slight ripple is evident in the sensor output.

Toner replenishment control by CPU 201 is hereinafter described in concrete terms.

Figure 6:
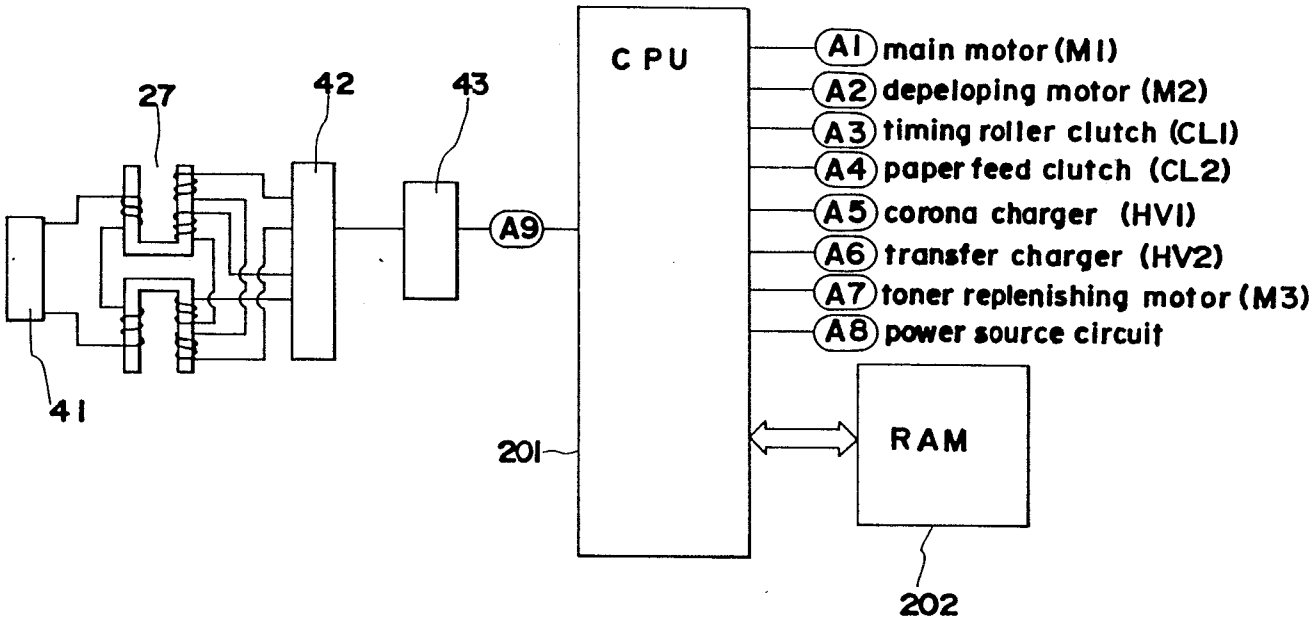
FIG. 6 shows a portion of the control circuit of the copy machine.

FIG. 6 shows a portion of the copy machine control circuit. CPU 201 output pins A1 through A7 are connected to the main motor M1 which actuates drives the photoreceptor drum, developing motor M2 which drives developing sleeve 18, timing roller clutch CL1, paper feed clutch CL2, corona charger HV1, transfer charger HV2, and toner replenishing motor M3, respectively. Output pin A8 is connected to a power source circuit not shown in the drawing.

Random access memory (RAM) 202 is provided a battery backup and is connected to CPU 201 via a data bus.

Figure 5:
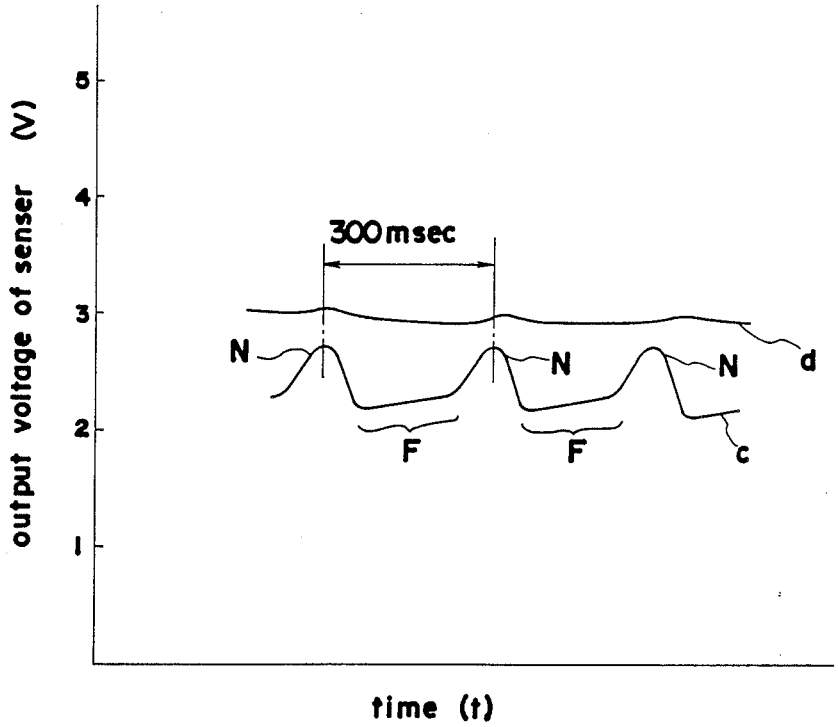
FIG. 5 shows the output waveforms of the toner concentration detecting sensor.

Toner concentration detecting sensor 27 detects signals output from oscillator 41 as the magnetic permeability of the developing material; variations in permeability are replaced by variations in coil inductance, and these signals are output to a phase comparator 42. Phase comparator 42 transmits these signals through a condenser 43 to a CPU 201 analog input port in the form of an analog signal, as shown in FIG. 5. The sensor output signal input to CPU 201 is converted to a digital signal by an A/D converter in said CPU, then stored in RAM 202 to be ready for output in data processing.

The control circuit processing sequence is hereinafter described.

Figure 7:
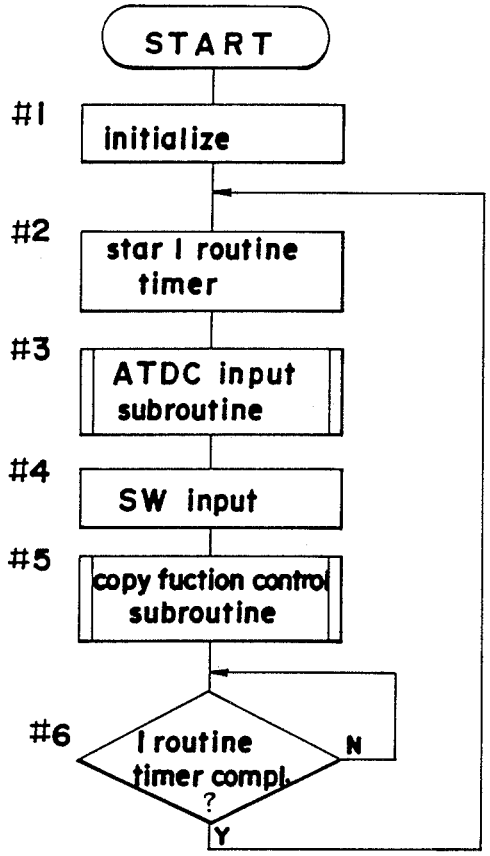
FIG. 7 is a flow chart of the main routine for copy operation control.

FIG. 7 shows the main routine of process sequences for the entire copy machine. When the power is switched ON, the control device is initialized in step 1, and in step 2 the 1-routine timer is started and the main routine is executed with each elapse of the set time period (10 ms in the present embodiment).

Continuing to step 3, the ATDC input subroutine is executed.

The ATDC input subroutine is a process for detecting toner concentration in the developing material based on the signals input to CPU 201 from toner concentration detecting sensor 27. The process is executed as described in FIG. 8, and details thereof follow.

In step 4, switch input is executed.

In step 5, the copy machine function control subroutine is executed according to the flow charts in FIGS. 11 through 14. The copy function control subroutine is a process which actuates main motor M1 and the like according to the timing chart shown in FIG. 15, executes the copy operation, and supplies toner to the developing unit based on the toner concentration detection results obtained in the aforesaid ATDC input subroutine.

In step 6, a determination is made as to whether or not 1-routine timer set in step 2 has completed; if said time has elapsed the routine returns to step 2 and the 1-routine timer is started again.

Figure 8:
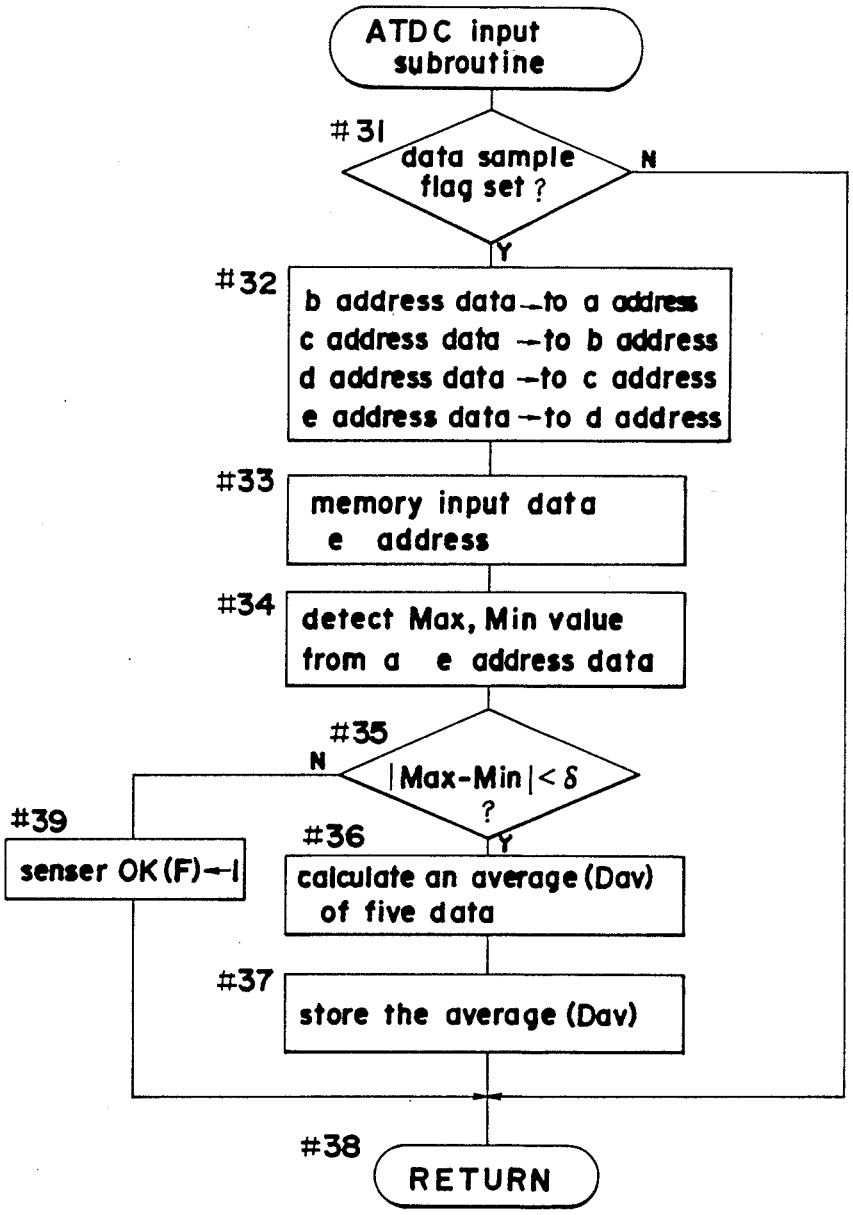
FIG. 8 is a flow chart for the ATDC input subroutine

An explanation of the ATDC input subroutine shown in FIG. 8 follows. In brief, the purpose of this subroutine is to detect toner concentration in the stable region F based on five sensor output sampling data successively converted to digital signals with each routine set time period (10 ms).

First, in step 31, a determination is made as to whether or not the sampling flag is set for sampling the data from detecting sensor 27 output. That is, it is determined whether or not the data sampling time has elapsed in the series of copy function shown in FIG. 15.

If the flag has been set, the routine continues to step 32, whereas if said flag has not been set the steps below step 32 are not executed and the sequence jumps in step 38 back to the main routine.

Figures 9, 10:
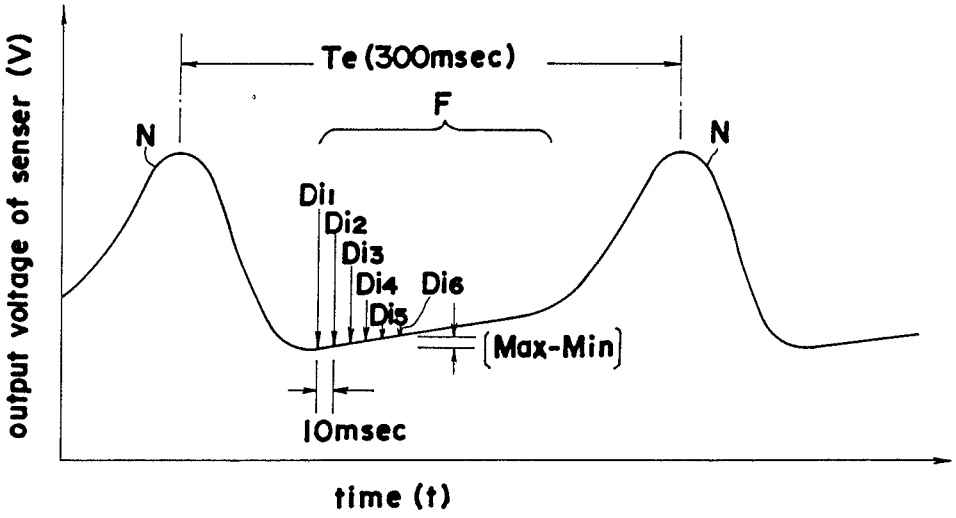
FIG. 9 shows the state of exchange of sampling data.
FIG. 10 is a diagram showing the method for data sampling.
Figure 11:
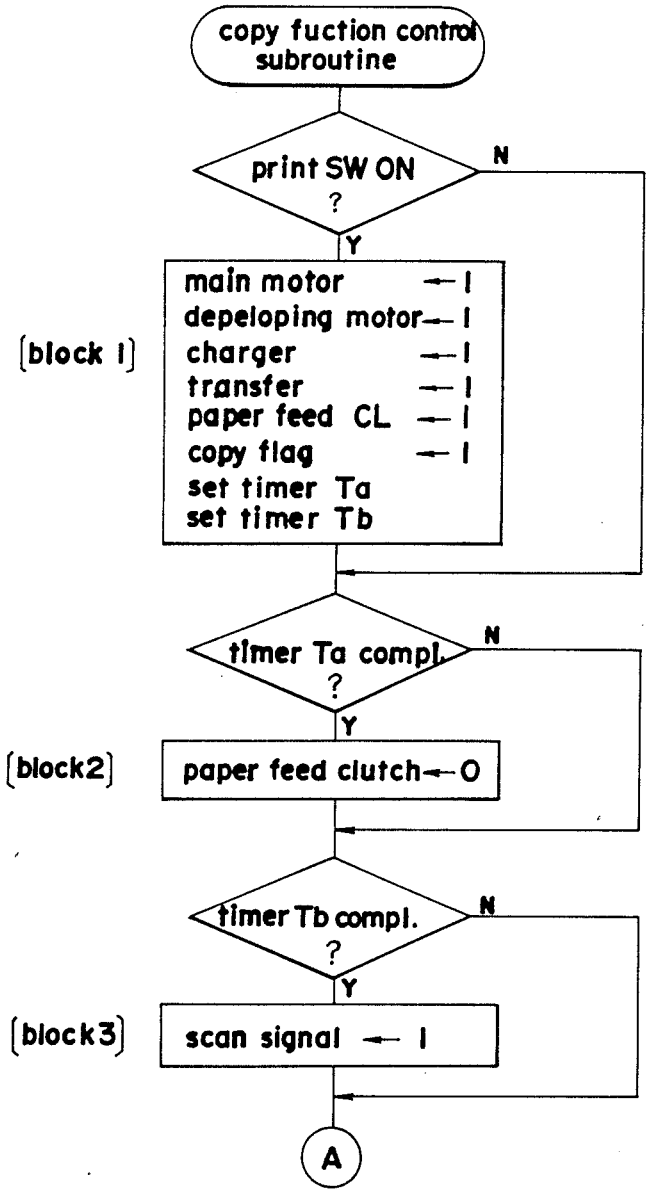
Figure 13:
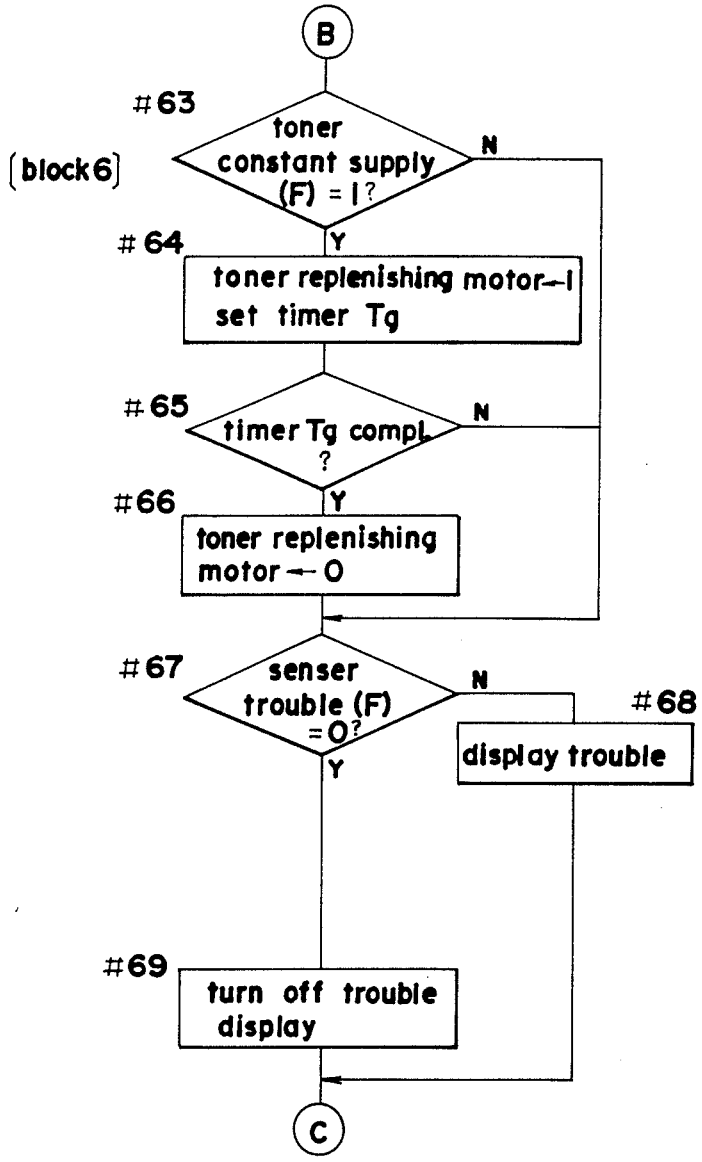
Figure 14:
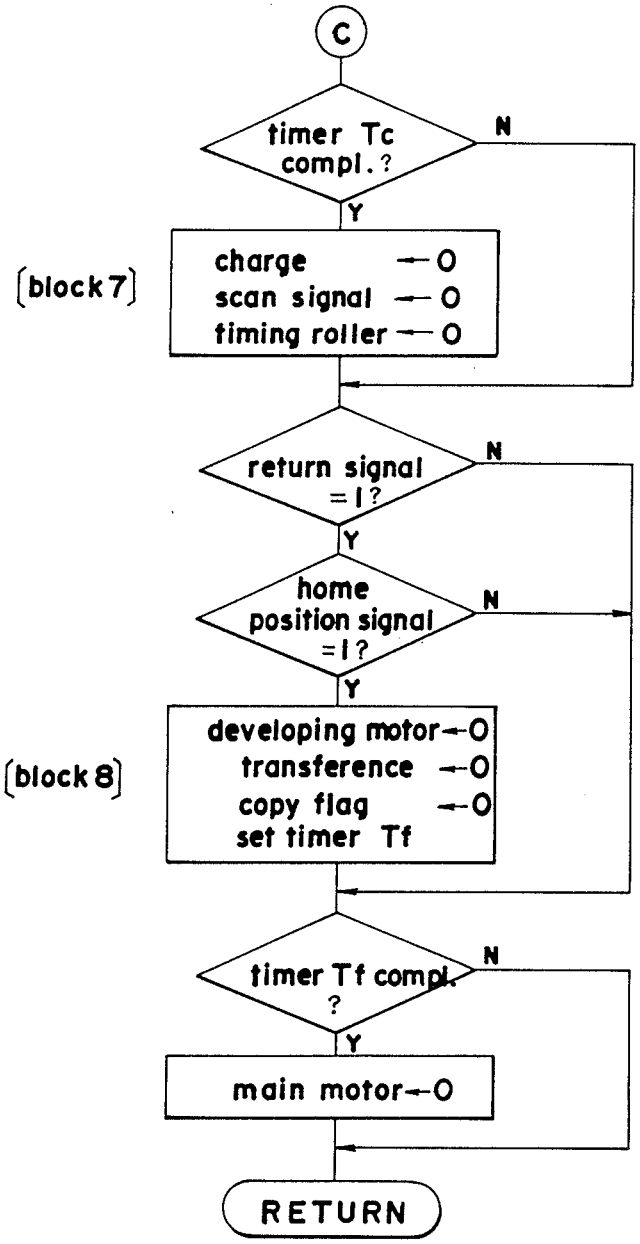

In step 32, Sampling data $Di_2$ through $Di_5$ stored at addresses b through e in RAM 202 are moved to addresses a, b, c and d respectively, as shown in FIG. 9.

In step 33, fresh sample data $Di_6$ is inputted to CPU 201 from sensor 27 following the elapse of the 1-routine set time of 10 ms, converted digital sampling data and stored in memory at address e.

In step 34, maximum (max) and minimum (min) values are obtained from the five sampling data $Di_2$ through $Di_6$ stored at the aforesaid addresses a through e. Then in step 35, a determination is made to as to whether or not the difference between maximum and minimum values $|max-min|$ falls within the reference value range $\delta$. It is to be noted that, in the present embodiment, reference value $\delta$ is set at 0.05 V. The processing in steps 34 and 35 assumes all five sampling data are available.

In the case where $|max-min|<\delta$, it is judged the sampling data $Di_2$ to $Di_6$ are those derived from the stable region F. Conversely, if the relation is $|max-min|>\delta$, the data $Di_2$ to $Di_6$ are found to be those derived from the ripple N portion.

Thus, if the relation is $|max-min|<\delta$, i.e. if the sampling data are those from the stable region F, the process proceeds to step 36, while on the contrary if the sampling data are those from the ripple N portion, the process jumps back to the main routine in step 38.

In step 36, the average value Dav of the five sampling data $Di_2$ to $Di_6$ for the addresses 1 through e is calculated, and in the subsequent step 37, a fresh average value Dav is stored in RAM 202 to replace the old value, and the process returns to the main routine in step 38.

The judgment made in step 35 was based on sampling data $Di_2$ through $Di_6$ obtained at each 1-routine set period of 10 ms, and this judgment also determines whether or not a variation greater than or equal to a set value occurs during the 50 ms period. If $|max-min|>\delta$, proper detection by toner concentration detecting sensor 27 and normal input of said sensor data to CPU 201 can be determined. An abnormality can be judged if $|max-min|\geqq\delta$ does not once occur during the set detection time Te. Time Te is set so as to be greater than the sensor surface 27*a* cleaning period.

In step 35, if $|max-min|\leqq\delta$, the toner concentration detection state is normal and the routine progresses to step 39 wherein the sensor OK flag is preset to 1. Toner concentration detection abnormality can be judged if the sensor OK flag registers 1 after completion of set detection time Te. Thereafter, the process returns to the main routine in step 38.

Copy function control subroutines shown in FIGS. 11 to 14, including that for toner replenishment control, are described hereinafter.

Figure 15:
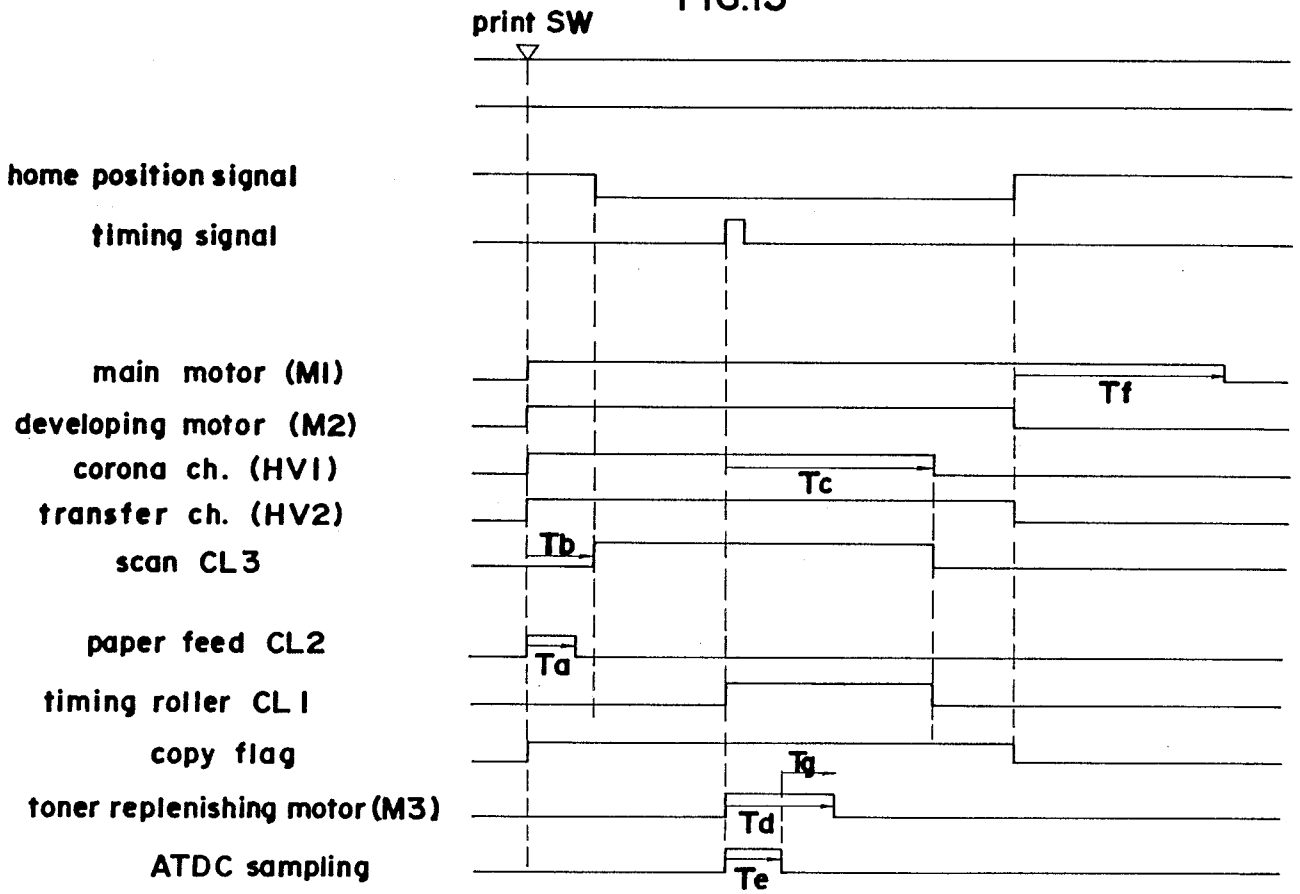
FIG. 15 is a timing chart showing the control state of the copy machine.

In Block 1, upon switching ON a print switch SW, main motor M1 for driving photoreceptor drum 4, developing motor M2 for driving the developing device, corona charger HV1, transfer charger HV2, and paper feed clutch CL1 are caused to function, while the copy flag indicating that the copying function is underway is set to "1," and timers Ta and Tb for control are started, as shown in the timing chart of FIG. 15.

In Block 2, completion of said timer Ta is judged so as to switch OFF the paper feed clutch.

In Block 3, timer Tb is checked for completion, so as to switch ON the scan clutch CL3 for the scan motor that drives the scanning unit (not shown in the drawings) and starting the scanning function.

In Block 4, when a timing signal is output by the actuation of a timing switch (not shown in the drawings) during the scanning operation, timing roller clutch CL1 is switched ON and a process is executed by which timer Tc is set. The copy paper sheet is transported synchronously with the image formed on the surface of photoreceptor drum 4.

Block 5 is a process for executing the 'oner replenishment function.

First, in step 50, the data sampling flag and data sampling timer Te are set. It is to be noted here that in the present embodiment, timer Te is set at 300 ms, which value is is in agreement with the period in which support shaft 11 is rotated as well as the period in which sensor surface 27*a* is cleaned. Furthermore, as previously described, 30 discreet pieces of data are sampled during the aforesaid time since the 1-routine timer is set at 10 ms.

Next, in step 71, a judgment is made as to whether or not to initiate toner replenishment in accordance with the sensor output as described below. In step 51, a determination is made as to whether or not the data sampling flag is set. If said flag is set, the routine continues to the next step 52, while if said flag is not set, the sequence jumps to step 56.

In step 52, a determination is made as to whether or not the sensor output average value Dav for the stable region F, which was calculated in the ATDC input subroutine, is 2.5 V or greater.

If the sensor output average value Dav is found to be greater than 2.5 V, i.e. if the toner concentration is less than the reference concentration, the toner is insufficient, and therefore, the procedure continues to the next step 53 to effect toner replenishment.

On the other hand, if the sensor output average value Dav is found to be equal to or less than 2.5 V, i.e. if the toner concentration is greater than the reference concentration, sufficient toner is present an replenishment is unnecessary so the procedure continues to step 56.

In step 53, the toner replenishing motor M3 is started to supply toner in the hopper 21 to the first transport path 8, and timer Td which determines the driving time for motor M3 is simultaneously started.

Subsequently, in step 54, a determination is made as to whether or not timer Td is completed, and if said timer Td has completed, the toner replenishing motor M3 is stopped in step 55, while if said timer is not completed, the procedure continues to step 56.

In step 56, a check is made to determine whether or not data sampling timer Te is completed. If said timer Te is completed, the procedure continues to step 57, while if it is not completed, the procedure proceeds to the next Block 6 as is.

In step 57, the data sampling flag is reset, then the procedure continues to step 58 where a determination is made as to whether or not the sensor OK flag was set at "1" during the set detection time Te. When the sensor OK flag is set to "1," the output from toner concentration detecting sensor 27, which is input to CPU 201 during the set detection time Te, varies by such that it is greater than the set value, thus toner concentration is normal.

Accordingly, when the sensor OK flag registers "1" in step 58, said flag is reset to "0" in step 59, and the sensor trouble flag is set at "0." The toner constant-volume replenishing flag, which requires constant-volume toner replenishment at times of abnormal toner concentration detection, is reset to "0" in step 60, and the procedure enters the subsequent Block 6.

Conversely, when the sensor OK flag registers "0" in step 58, the routine proceeds to step 61 and the sensor trouble flag, which indicates abnormal toner concentration detection, is set at "1," then in step 62 the toner constant-volume replenishment flag is set at "1," and the procedure enters the subsequent Block 6.

Block 6 is the toner constant-volume replenishment process wherein, first, in step 63, a determination is made as to whether or not the toner constant-volume replenishment flag registers "1." If said flag is not set at "1," the procedure continues to step 67 as is, since such indicates toner concentration detection is normal and constant-volume replenishment is not required.

When the toner constant-volume replenishment flag registers "1" in step 63, toner constant replenishment is accomplished in step 64. More concretely, in step 64 the toner replenishment motor M3 is started and timer Tg is set for toner constant supply. Then, in step 67, a check is made to determine whether or not timer Tg is completed. If said timer Tg is completed, the toner replenishing motor M3 is stopped in step 66, toner constant-volume supply is terminated, and the procedure continues to step 67. However, if toner Tg is not completed in step 65, toner constant supply continues and the procedure proceeds to step 67.

In step 67, a determination is made as to whether or not the sensor trouble flag registers "0." If said flag does not register "0," the routine continues to step 68 and the trouble display is activated. Thus, the machine operator is alerted to the toner concentration detection abnormality.

Subsequently, in step 69, toner concentration detection is deemed normal including time when the sensor flag registers "1" following toner constant-volume replenishment, and the trouble display is extinguished if it is ON.

Thereafter, the routine proceeds to Block 7 wherein timer Tc is checked for completion, and corona charger HV1, scan clutch CL3, and timing roller clutch CL1 are switched OFF. It is to be noted here that timer Tc may be variably set in accordance with the size of the copy paper sheet used.

Next, in Block 8, the optical system is returned to a set position in response to the return function, the set position switch (not shown in the drawings) is switched ON, and developing motor M2 and transfer charger HV2 are switched OFF. Then, the copy flag is set to "0" and the process to set timer Tf is executed.

In Block 9, timer Tf is checked for completion, the main motor is switched OFF, and the sequence returns to the main routine.

According to the present invention having the construction and operation as previously described, toner concentration is detected and toner replenishment is accomplished based on the results of said detection, and even if, for some reason, a toner concentration detection abnormality occur, said abnormality is automatically detected and the toner replenishing mode is switched to constant-volume supply. Thus, abnormal image density does not result from abnormalities in the detection of toner concentration, and image formation of suitable quality can be continuous. Further, as image formation continues, the toner concentration detection abnormalities are suitably countered.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

I claim:

1. A control apparatus for controlling a concentration of toner incorporated in developing a material in a developing unit, comprising:

a toner concentration detecting sensor, provided in the developing unit, for detecting said toner concentration;

abnormality discriminating means for discriminating an abnormal state in which said detecting sensor is incapable of detecting an accurate toner concentration, and for outputting an abnormal signal indicating the abnormal state;

toner replenishing means for replenishing toner to the developing unit; and control means for controlling said toner replenishing means to replenish the toner in accordance with the toner concentration detected by said toner concentration detecting sensor in a first state wherein said abnormality discriminating means does not output the abnormal signal, and to replenish the toner by a constant volume at a predetermined period in a second state wherein said abnormality discriminating means outputs the abnormal signal.

2. A control apparatus of claim 1, wherein said developing unit further comprises a mixing member for mixing the developing material, and said toner concentration detecting sensor arranged in a vicinity of the mixing member.

3. A control apparatus of claim 2, wherein said mixing member transports the developing material while mixing the same.

4. A control apparatus of claim 2, further comprising:

a cleaning member for cleaning said toner concentration detecting sensor.

5. A control apparatus of claim 4, wherein said cleaning member is provided on said mixing member.

6. A control apparatus of claim 1, wherein the toner concentration detecting means detects a variation in magnetic permeability of the toner incorporated in the developing material.

7. A control apparatus of claim 1, wherein the abnormality discriminating means detects the abnormal state by means of a peaked ripple which does not appear in an output waveform of said toner concentration detecting sensor during the predetermined period.

8. A control apparatus of claim 1, further comprising:

means for informing the abnormal state in response to the abnormal signal from said abnormality discriminating means.

9. A control apparatus for controlling a concentration of toner incorporated in developing material in a developing unit, comprising:

a toner concentration detecting sensor, provided in the developing unit, for detecting said toner concentration;

abnormality discriminating means for discriminating an abnormal state in which said detecting sensor is incapable of detecting an accurate toner concentration, and for outputting an abnormal signal indicating the abnormal state;

toner replenishing means for replenishing toner to the developing unit; and control means for controlling said toner replenishing means to replenish the toner in accordance with the toner concentration detected by said toner concentration detecting sensor in a first state in which said abnormality discriminating means does not output the abnormal signal, and to replenish the toner by a constant volume without regard to the toner concentration detected by said toner concentration detecting sensor in a second state in which said abnormality discriminating means outputs the abnormal signal.

10. A method of controlling a concentration of toner incorporated in developing material in a developing unit, comprising the steps of, discriminating an abnormal state in which a detecting sensor for detecting toner concentration is incapable of detecting an accurate toner concentration;

stopping a replenishment of toner according to the detecting sensor when the abnormal state is discriminated; and starting replenishment of toner without regard to the toner concentration detected by the detecting sensor.

11. A method of controlling a concentration of toner incorporated in developing material in a developing unit, comprising the steps of, discriminating an abnormal state in which a detecting sensor for detecting toner concentration is incapable of detecting real toner concentration; and changing a manner of toner replenishment for the developing unit from a first manner in which the toner is replenished in relation to the concentration detected by the detecting sensor to a second manner in which a constant amount of toner is replenished.

* * * * *